United States Patent [19]

Cunnion, Jr. et al.

[11] Patent Number: 4,664,728

[45] Date of Patent: May 12, 1987

[54] EXPLOSIVE SYSTEMS

[75] Inventors: James P. Cunnion, Jr., Audubon; Bruce W. Sands, Malvern, both of Pa.

[73] Assignee: PQ Corporation, Valley Forge, Pa.

[21] Appl. No.: 800,561

[22] Filed: Nov. 21, 1985

[51] Int. Cl.[4] ..... C06B 45/00

[52] U.S. Cl. ..... 149/2; 149/21; 149/41; 149/45; 149/46; 149/43; 149/61; 149/108.8

[58] Field of Search ..... 149/2, 21, 43, 108.8, 149/41, 46, 61, 45

[56] References Cited

U.S. PATENT DOCUMENTS

| | | | |
|---|---|---|---|
| 3,995,673 | 12/1976 | Grigaitis et al. | 149/21 |
| 4,141,766 | 2/1979 | Cameron et al. | 149/21 |
| 4,357,184 | 11/1982 | Binet et al. | 149/21 |
| 4,523,967 | 6/1985 | Cartwright | 149/21 |
| 4,525,225 | 6/1985 | Cechanski | 149/21 |
| 4,547,232 | 10/1985 | Cartwright | 149/45 |
| 4,555,276 | 11/1985 | Winston | 149/21 |

*Primary Examiner*—Stephen J. Lechert, Jr.

*Attorney, Agent, or Firm*—Ernest G. Posner; Stephen Bobb; Fred C. Philpitt

[57] ABSTRACT

Water-based explosives that use siliceous boron-containing microspheres as sensitizing agents are stabilized by adding multivalent metal ions to the explosives. Zinc salts are especially useful.

4 Claims, No Drawings

EXPLOSIVE SYSTEMS

BACKGROUND OF THE INVENTION

This invention relates to improved explosives that contain water. In particular the invention provides for the addition of zinc salts to stabilize water-containing explosives that require largely siliceous or borosilicate microspheres that tend to be reactive.

Slurry, emulsion and gelled explosives contain an inorganic oxidizing salt, a carbonaceous fuel source and a vehicle, usually water, with materials required to provide the desired rheology. Such explosives also require additional ingredients to assure detonation. U.S. Pat. No. 3,456,589, among many others, suggests that hollow glass microspheres when added to slurry explosives provide enhanced sensitivity. Such glass microspheres often contain boron and are alkaline. These constituents can be leached in the aqueous system so that the pH of the system is raised and the desired rheology is altered. Additional acid may be added to the system to mitigate these problems; however, the glass microspheres are often degraded and become filled with liquid. Liquid filled microspheres do not sensitize these explosive systems. Hollow microspheres with shells of silicate and polysalt are described in U.S. Pat. Nos. 3,794,503 and 3,796,777. These microspheres do not have fused shells and are more sensitive to the aqueous environment. The shells of the silicate-polysalt microspheres are strengthened and rendered more water resistant by exposure to multivalent metal ions as described in U.S. Pat. No. 4,340,642. Although such microspheres remain intact in water-based explosives they still tend to contribute sufficient boron and alkali to cause undesirable changes.

It is an object of this invention to provide stable water-based explosives that contain alkaline hollow microspheres as sensitizers, said microspheres having shells that contain alkali, silica and boron.

SUMMARY OF THE INVENTION

We have found that the addition of an initially water-soluble zinc salt to water-based explosives with alkaline hollow microspheres as sensitizers provides a stable system. We have further found that explosives containing alkaline hollow microspheres with non-fused silicate-polysalt shells benefit greatly from the addition of zinc according to our invention.

THE INVENTION

Nearly all water-containing explosive systems can be sensitized with microspheres that contain alkali, silica and boron when zinc salts are added to control the alkalinity and boron leaching. Indeed, probably any such systems that are compatible with the microspheres can be so improved. These explosives comprise water as a vehicle, inorganic oxidizing agents such as ammonium nitrate, carbonaceous fuels such as waxes or fuel oils, and components to control the rheology such as guar gums and alginates, among others. In the explosives of our invention sensitizing agents other than hollow microspheres are not excluded, such as fine particles of aluminum and/or magnesium. These materials can also provide some fuel as well.

The hollow microspheres useful as sensitizing agents and improved by our invention can be any that are alkaline and contain silica or silicate with boron or other materials that interact with the active components of the explosive. Such microspheres are described in U.S. Pat. Nos. 2,797,201; 2,978,340; 3,030,215, 3,365,315 and 3,699,050, among others. These U.S. Patents are hereby incorporated by reference as describing useful hollow microspheres.

Hollow microspheres that benefit greatly from our invention are those with shells of alkali metal silicate and a polysalt, usually a borate. These materials are described in U.S. Pat. Nos. 3,796,777 and 3,794,503. These patents are hereby incorporated by reference as describing preferred hollow microspheres for the explosives of our invention. These microspheres are prepared by spray drying a homogeneous solution of a silicate, usually sodium silicate, and a polysalt selected from the group consisting of ammonium pentaborate, sodium pentaborate and sodium hexametaphosphate followed by further drying to reduce the water content from above about 10% to less than about 7%. The product is a mass of very small hollow spheres with shells composed of the reaction and dehydration products of the silicate and polysalt. The dried hollow microspheres can be classified by various techniques to provide various screen sizes.

Salts of multivalent cations can provide improved stability to water-based explosives with boron-containing siliceous microspheres as sensitizing agents. We prefer soluble zinc salts and especially zinc nitrate. The zinc salts are particularly useful when silicate polysalt microspheres are the sensitizing agent.

The explosives of our invention can contain from 2 to 20% w/w of hollow microspheres. The multivalent or preferably zinc salts are added at about 2 to 20 pbw for 100 pbw of the microspheres.

The improved explosives of our invention are useful for any work requiring explosives and have the advantages over the prior art disclosed herein.

EXAMPLES

The following examples illustrate certain embodiments of our invention. These examples are not provided to establish the scope of this invention, which is described in the disclosure and recited in the claims. The proportions are in parts by weight (pbw) or percent by weight (% wt/wt) unless otherwise indicated.

EXAMPLE 1

A water-based explosive system was prepared excluding the fuel component, said system containing 50 pbw $NH_4NO_3$, 10 pbw $NaNO_3$, 1 pbw guar gum and 40 pbw of $H_2O$. This system 97 pbw was combined with 3 pbw of hollow silicate-based polyborate microspheres (6% LOI) and 0.1 to 0.3 pbw of $Zn(NO_3)_2 6H_2O$. The various samples were tested for pH when prepared and after 30 days. The results are summarized in the following table.

TABLE 1

| Sample | Microspheres Added (pbw) | $Zn(NO_3)_2$ Added (pbw) | pH(I) | pH (30 days) | Viscosity (30 days) |
|---|---|---|---|---|---|
| 1 | None | None | 4.6 | 4.6 | Liquid |
| 2 | 3 | None | 6.8 | 7.2 | Gel |
| 3 | 3 | 0.10 | 5.6 | 6.6 | Liquid |
| 4 | 3 | 0.15 | 5.3 | 5.9 | Liquid |
| 5 | 3 | 0.30 | 5.3 | 5.8 | Liquid |

I = Initial

We claim:

1. In water-containing slurry explosives sensitized with hollow microspheres containing alkali, silica and boron the improvement comprising the addition of a sufficient amount of an inorganic salt of a multivalent cation to provide an explosive of stable pH and viscosity.

2. The explosive of claim 1 wherein the explosive contains 2 to 20 parts by weight of said inorganic salt for 100 pbw of said microspheres.

3. In water-containing slurry explosives sensitized with hollow microspheres containing alkali, silica and boron the improvement comprising the addition of a sufficient amount of zinc salt to provide an explosive of stable pH and viscosity.

4. The explosive of claim 3 wherein the explosive contains 2 to 20 parts by weight of said zinc salt for 100 pbw of said microspheres.

* * * * *